United States Patent [19]

Welsh

[11] 4,135,456

[45] Jan. 23, 1979

[54] POWERED RAILWAY CAR STEERING ASSEMBLY

[75] Inventor: Patrick G. Welsh, Glen Ellyn, Ill.

[73] Assignee: Pullman Incorporated, Chicago, Ill.

[21] Appl. No.: 800,686

[22] Filed: May 26, 1977

[51] Int. Cl.[2] ..... B61F 3/06; B61F 5/22; B61F 5/30; B61F 5/46

[52] U.S. Cl. ..... 105/135; 105/166; 105/168; 105/171; 105/199 S; 105/210

[58] Field of Search ..... 105/4 R, 109, 118, 133, 105/135, 165, 166, 167, 168, 171, 174, 175 R, 176, 179, 199 S, 210; 180/12; 280/10

[56] References Cited

U.S. PATENT DOCUMENTS

| | | | |
|---|---|---|---|
| 118,515 | 8/1871 | Clark | 105/166 |
| 184,823 | 11/1876 | Bleakley | 105/166 |
| 299,735 | 6/1884 | Candee | 105/168 X |
| 455,460 | 7/1891 | Gidley | 105/166 |
| 749,947 | 1/1904 | Nordell | 105/166 |
| 1,723,720 | 8/1929 | Buchli | 105/166 X |
| 1,855,997 | 4/1932 | Shannon | 105/166 |
| 2,036,194 | 4/1936 | Burrows et al. | 105/118 |
| 2,115,466 | 4/1938 | Newton | 105/166 |
| 2,643,895 | 6/1953 | Stover | 280/100 X |
| 2,935,031 | 5/1960 | Cripe | 105/4 R |
| 3,061,029 | 10/1962 | Pryor | 180/1 Z |
| 3,528,374 | 9/1970 | Wickens | 105/176 X |

*Primary Examiner*—Francis S. Husar
*Assistant Examiner*—Howard Beltran
*Attorney, Agent, or Firm*—Thomas G. Anderson

[57] ABSTRACT

A railway car includes a central steering axle transversely movable on the car body in response to track curvature. Actuating members connected to the transversely movable axle include longitudinally extensible and retractable elements which steer end axle assemblies about vertical pivot axes, the actuating members and associated elements including helical gearing.

12 Claims, 8 Drawing Figures

30
27
29
52
38
42
43
44
45
48
49
47
46
28
19
17
31
33
35
34
36
37
7

11
50
39
14
44
43
41
47
45
42
40
49
46
51
38

POWERED RAILWAY CAR STEERING ASSEMBLY

BACKGROUND OF THE INVENTION

1. Field of the Invention

The field of invention generally pertains to railway car steering assemblies wherein the outer or end axles of the car are steered by the movement of an intermediate axle and wheel assembly.

2. Description of the Prior Art

The prior art is disclosed in U.S. Pat. Nos. 118,515, Aug. 29, 1871; 455,460 July 7, 1891 and 749,947 Jan. 19, 1904 each of which shows an articulated railway car truck.

The present invention is an improvement over the aforementioned patents.

SUMMARY OF THE INVENTION

The present invention is particularly adaptable to relatively small, personal type, railway cars aptly described in the art as people movers. Cars of this type are usually capable of transporting up to six or eight passengers and are each self-propelled and generally dispatched and operated by computerization. It is well recognized in the art that wheel noise and other problems can be greatly eliminated if the end axles are permitted to steer when the car is traveling around curves.

In the present invention an intermediate axle is movable transversely on bearing structures provided on the intermediate axle and on the underneath side of the car body. The end axles are connected to the car body by vertical pivot pins which permit these axles to pivot about vertical axes. The end axles are connected to the intermediate or central axis axle by actuating members in the form of telescoping members or rods which relatively extend and retract as the transverse axle is movable in response to traveling on a curved track. The telescoping members are suitably connected at opposite ends to their respective axles by means of universal joints. The extension and retraction is provided by helical gearing contained on certain of the telescoping rods engageable with helical gearing provided in the interior of the mating and cooperating tubular members of each of the actuating assemblies. Thus as the central axle and wheel assembly is moved laterally in one direction by virtue of track curvature the actuating members on one side of the car are extended whereas the actuating members on the other side of the car are contracted this in turn effectuating rotational steering of the outer or end axles. The helical gearing provides for coordinated extension and retraction of the actuating members.

DESCRIPTION OF THE PREFERRED EMBODIMENT

Figure 1:
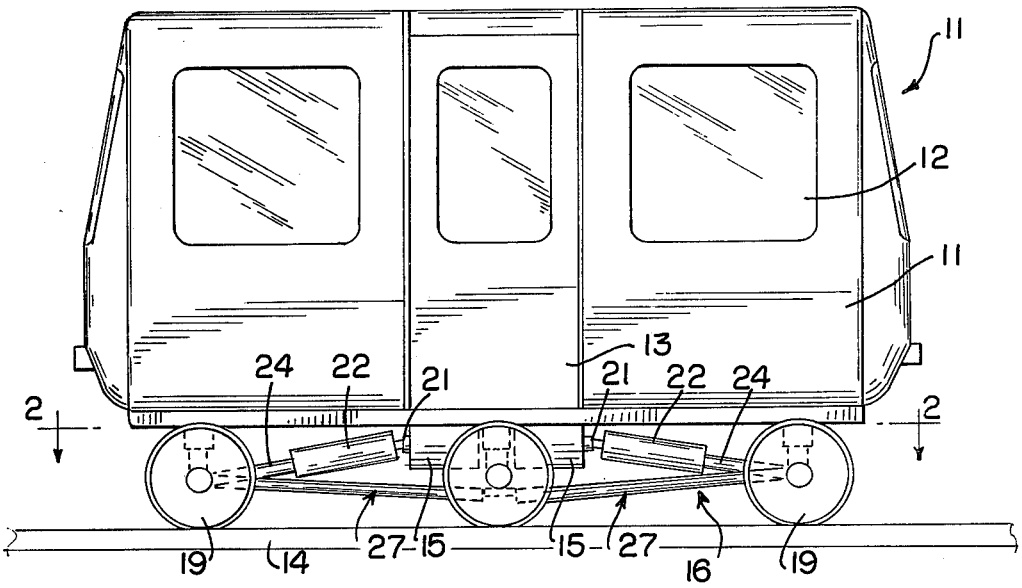
FIG. 1 is a side elevational view of a railway vehicle of the people mover type supported on a conventional railway track.

In FIG. 1 a railway car 10 comprises a car body 11 having the usual windows 12 and door access means 13. The car 10 is supported on a railway track 14 and the particular car is of the relatively small and compact passenger type known in the field as people movers. This type of transit car is self-propelled and includes a pair of propulsion motors 15 suitably supported on the underneath side of the car body 11.

Figures 5, 6, 7, 8:
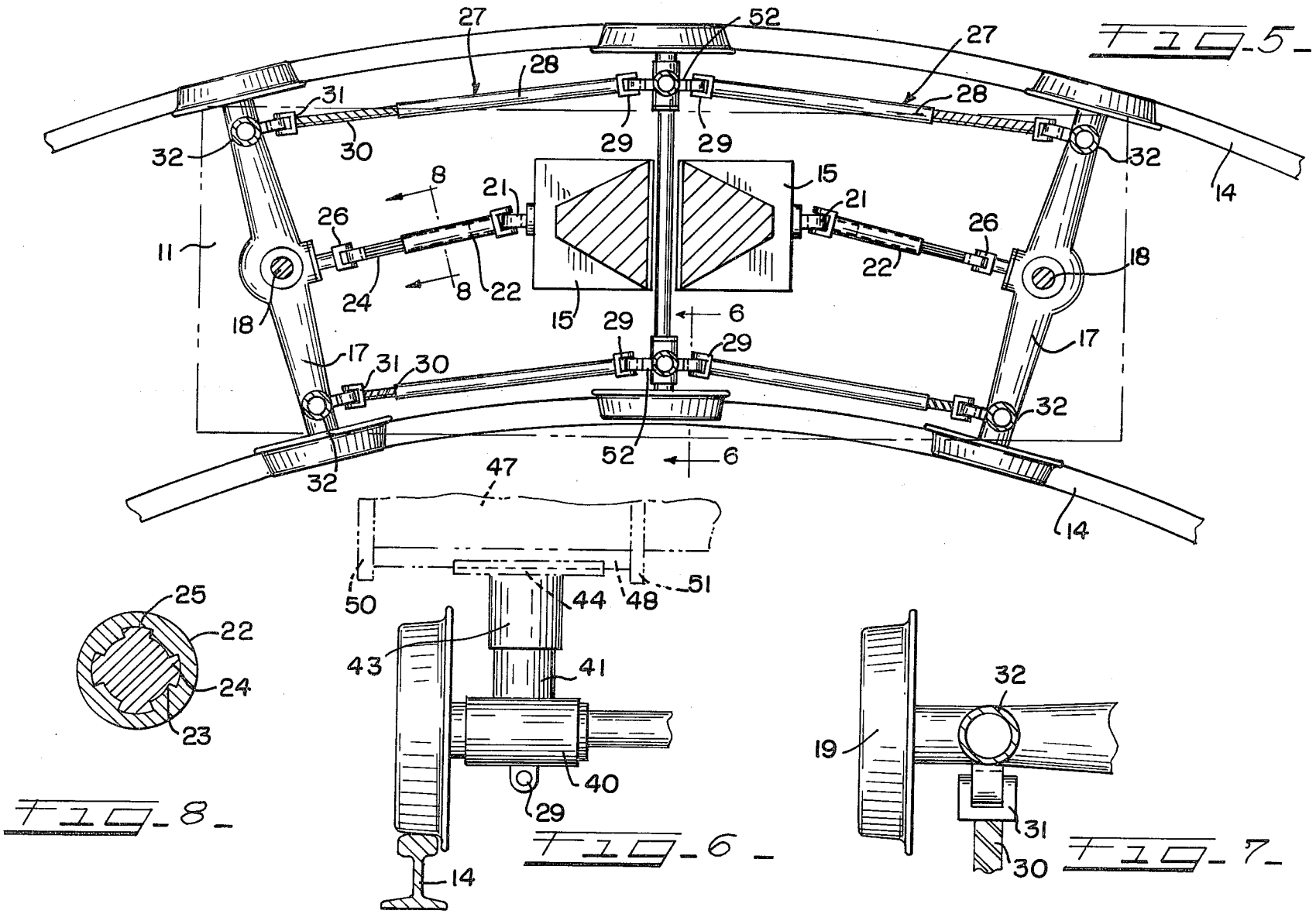
FIG. 5 is a view similar to FIG. 2 disclosing the position of a steering assembly on a curved track.
FIG. 6 is a cross-sectional view taken substantially along the line 6—6 of FIG. 5.
FIG. 7 is a cross-sectional view taken substantially along the line 7—7 of FIG. 3.
FIG. 8 is a cross-sectional view taken along the line 8—8 of FIG. 5.

An axle and wheel assembly 16 includes a pair of end or first axle assemblies designated at 17. The axle assemblies 17 are connected to the car body 11 to pivot about central pivot members designated at 18 so that the axle 17 may be pivoted about vertical axes during steering. Driven car wheels 19 are supported on each of the axles 17. A drive assembly from each of the propulsion motors 15 includes universal joint connections 21 which in turn drive tubular drive members 22 internally spliced by the inclusion of splines 23 as best shown in FIG. 6. A telescopic drive member 24 is slidingly connected to each of the tubular drive members 22 and in turn includes splines 25 as best shown in FIG. 6. The universal joint 26 connects each of the telescoping drive members 24 to the tubular drive members 22. The universal joint 26 is also connected centrally to each of the end axles 17.

Figure 2:
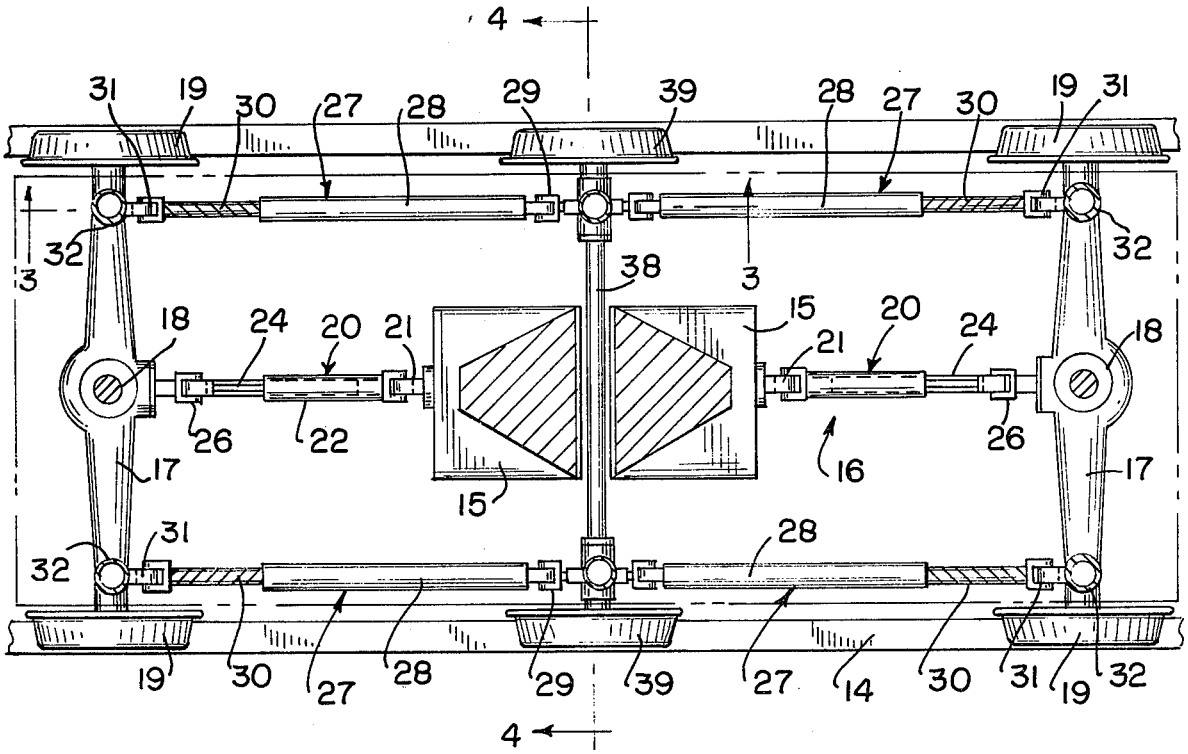
FIG. 2 is a cross-sectional view taken substantially along the line 2—2 of FIG. 1.

Steering movement of the end axle 17 is effectuated by steering actuating members 27 positioned on opposite sides of the axle and wheel assembly 16. As indicated four steering actuating members 27 are provided. Each consists of a tubular telescoping member 28 having internal helix gearing or threads extending throughout each of the members. A universal connection 29 connects the inner ends of the tubular members 28 to the intermediate axle as will be described. Each of the actuating members 27 also includes a helically threaded telescoping rod 30 in telescoping relation with respect to the tubular telescoping member 28. Each of the rods 30 is connected by means of a universal joint connection 31 to the end axle assembly 17. The helically threaded telescoping rods 30 thus engage complemental threads within the members 28 and rotate with respect thereto to provide for extension and retraction of the steering actuating members 27. As best shown in FIGS. 2 and 7 the end axles 17 are supported on spring suspensions 32 relative to the body 11. Each of the axles is provided at opposite ends thereof with vertical tubular spring supports 33 within which are disposed springs 34. The springs 34 also extend within tubular retainer sections 35 slidingly engagable with the spring supports 33. The retainer sections 35 are secured to spacer members 36 in turn projecting downwardly from transverse boxlike tubular supports 37 secured to the car body 11.

Figure 3:
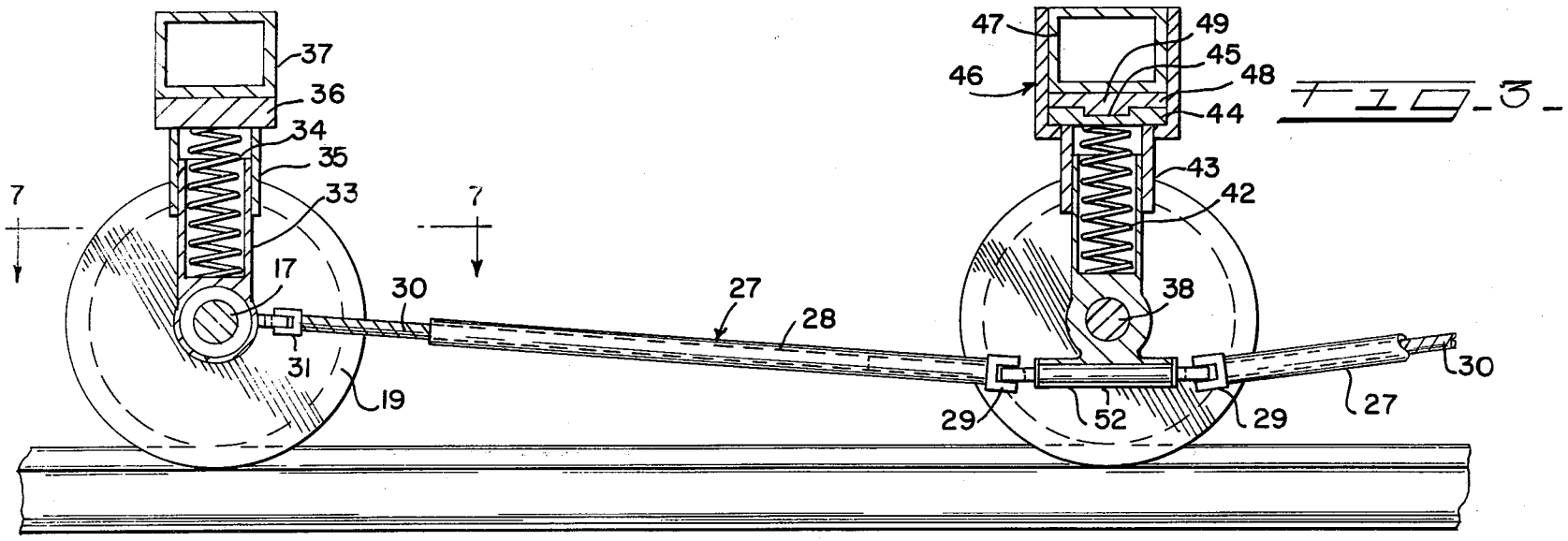
FIG. 3 is a cross-sectional view taken substantially along the line 3—3 of FIG. 2.
Figure 4:
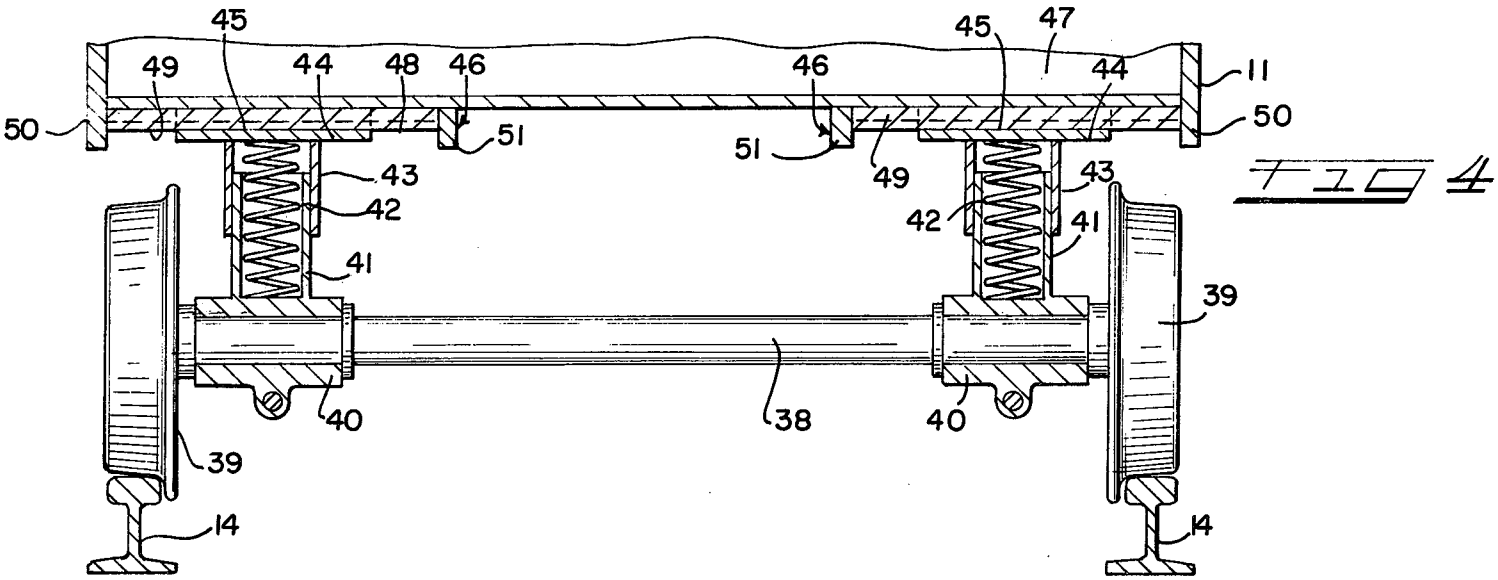
FIG. 4 cross-sectional view taken substantially along the line 4—4 of FIG. 2.

As best shown in FIGS. 2, 3, and 4 a central steering axle 38 is supported on steering wheels 39 which are also spring supported relative to the body. Spring support bearings connected to the axle 38 support vertical tubular housings 41 which in turn support coil springs 42. The coil springs 42 extend upwardly into tubular spring retainers 43 in turn fixedly secured to lower bearing plates 44 slidably supported on the body for relative transverse movement. The lower bearing plate 44 includes a key way or slot 45. A bearing housing 46 is fixedly secured to a transversely extending box beam also rigidly secured to the car body. The bearing housing is adapted to confine and support the lower bearing plate 44 for lateral or relative movement transversely of the car. A fixed bearing plate 48 is positioned within the housing 46 and is fixedly secured to the transverse box support 47. The fixed bearing plate 48 includes a projecting key 49 which extends into the transverse groove 45 so that the lower bearing plate 44 and the axle 38 has limited transverse movement relative to the car when the car is moving about a curved track. Transverse movement of the bearing plate 45 and axle assembly 38 is limited by an extension plate of the body 50 and an inner plate 51 which both define the extent of movement of the intermediate axle 38. As best shown in FIG. 3 a bracket 52 extending downwardly from the bearing 40 supports the universal joint connections 29.

THE OPERATION

As shown in FIG. 2 when the car is moving along a straight track the intermediate axle and wheels 39 are all longitudinally aligned. As the car negotiates a curve in the track as disclosed in FIG. 5 the central axle 38 is moved laterally outwardly relative to the car body and as this occurs the end axles 17 now assume the position shown in FIG. 5 wherein the helically threaded rods 30 are rotated and retracted into the position shown. On the other hand, the rods 30 on the other side of the assembly are extended as indicated having been rotated to this position as the intermediate axle assumes the position indicated. It is thus obvious that the driven wheels 19 now may negotiate the curve easily without the attendant problems of non-steerable axle constructions as are conventional in railway cars. During this extension and retraction of the telescoping members and actuating members the tubular drive member 22 also is extended and retracted while the propulsion motors propel the cars along the track.

Thus stated in another manner as the car enters the curve, the end axle flanges on the outside of the curve contact the rail and as the car continues through the curve, the flange of the middle axle contacts the rail on the inside of the curve causing the wheel geometry to conform to the curve. In conforming to the curve the middle axle therefore must undergo an axial movement the magnitude of which is the function of the curve sharpness. In FIG. 5 a 50 ft. radius curve is illustrated which in the present size car requires a movement of the intermediate axle of approximately 1 ft. and $\frac{7}{8}$ inches. As the axial movement of the middle axle progresses the four helix assemblies undergo a lengthening for the two helices on the outside of the curve and a corresponding shortening of the two steer helices on the inside of the curve. Therefore all differential movements, that is, shortening and lengthening of the assemblies are equal. The resulting axle geometry regardless of the sharpness of the curve is such that the center line of all axles are pointed toward the center of curvature. This being the case, the curving action is completely rolling free and without noise, scrub axles, etc.

The present bearing construction disclosed will avoid differential torque problems with the middle axle. The middle axle necessarily must bear a significant load which generally should be approximately 20% of the car weight. As indicated, each of the middle axle bearings are of the double thrust configuration and are constrained in all directions except vertical.

The present arrangement is particularly advantageous since the linkages or actuating members are on the sides of the vehicle and therefore provide room in the center portion of the vehicle for necessary propulsion equipment, etc. Also, it is advantageous to carry the motors on the vehicle frame in the position indicated in order to guarantee the proper functioning of the vehicle suspension and steering action.

What is claimed is:

1. A railway car having a body,
a drive motor means to power said car, a pair of first axles including flanged drive wheels mounted on said first axles,
means connected said first axles at opposite ends of said body for pivotal steering movement of said first axles about vertical axis,
a second axle having flanged wheels positioned on said body between said first axles,
means connecting said second axle to said body for relative transverse guiding movement; the improvement of a steering arrangement for said first axles comprising:
two pairs of longitudinally extending and laterally spaced telescoping actuating members,
means pivotally connecting first ends of each of said pairs of actuating members to said second axle,
means connecting the other ends of said respective pairs of actuating members to said first axles, and
each actuating member being operatively inter-reactive with the others whereupon transverse guiding movement of said second axle urges extension of one of said pairs and corresponding retraction of the other in response to track curvature to provide relative steering movement to said first axles and drive wheels in relation to the curve.

2. The invention in accordance with claim 1,
said first ends of said pairs of actuating members being connected to said second axle at opposite sides thereof,
and said actuating members of each pair being in substantially parallel relation.

3. The invention in accordance with claim 1,
each of said actuating members comprising relatively telescoping elements.

4. The invention in accordance with claim 3,
said telescoping element including universal joints connecting said actuating members to said axles.

5. The invention in accordance with claim 4,
said telescoping elements being axially rotatable relative to each other.

6. The invention in accordance with claim 1,
said actuating members each comprising a pair of telescoping members relatively rotatable and during said rotation providing for extension and retraction of said members.

7. The invention in accordance with claim 6,
said telescoping members being interconnected by helical gearing.

8. The invention in accordance with claim 1,
said actuating members comprising a pair of relatively movable rod-like elements, and
helical gearing interconnecting said elements whereby said rod-like elements during transverse movement of said second axle are extended and retracted.

9. The invention in accordance with claim 8,
wherein said drive motor is a propulsion motor mounted on said body, drive means connected to said motor means and said first axles, said drive means including universal joint connections.

10. The invention in accordance with claim 9, said drive means including first and second telescoping drive members.

11. The invention in accordance with claim 1, said means for connecting said second axle to said body for transverse guiding movement comprising first bearing means on said body above said second axle, and second bearing means on said second axle engaging said first bearing means for limited transverse sliding movement.

12. The invention in accordance with claim 11, including spring support means between said second bearing and said second axle.

* * * * *